United States Patent [19]

McCoy

[11] 4,230,060

[45] Oct. 28, 1980

[54] SAILING SYSTEM

[76] Inventor: John D. McCoy, 719 N. 91st St., Seattle, Wash. 98103

[21] Appl. No.: 850,711

[22] Filed: Nov. 11, 1977

Related U.S. Application Data

[63] Continuation-in-part of Ser. No. 705,590, Jul. 15, 1976, abandoned.

[51] Int. Cl.[3] ..... B63H 9/04

[52] U.S. Cl. ..... 114/39; 114/90; 114/98; 114/102; 114/103

[58] Field of Search ..... 114/39, 90, 89, 92–99, 114/102, 103, 113, 104–107, 108

[56] References Cited

U.S. PATENT DOCUMENTS

| | | | |
|---|---|---|---|
| 1,613,890 | 1/1927 | Herreshoff | 114/90 X |
| 3,132,620 | 5/1964 | Court | 114/39 |
| 3,802,371 | 4/1974 | Jastrab | 114/39 |

FOREIGN PATENT DOCUMENTS

| | | | |
|---|---|---|---|
| 1117529 | 6/1968 | United Kingdom | 114/102 |

*Primary Examiner*—Sherman D. Basinger
*Attorney, Agent, or Firm*—Delbert J. Barnard

[57] ABSTRACT

A mast is mounted onto a boat for 360° rotation about its longitudinal axis, relative to the sailboat and the rigging for the mast. The rigging braces the mast against buckling and comprises a masthead, a transverse spreader bar and shrouds. A forwardly directed longitudinal channel in the mast receives bolt ropes at the forward edges of two soft fabric panels which together make up the mainsail. Each mainsail panel extends from its bolt rope within the channel out through a narrow slot in the mast. When sailing generally into the wind, each mainsail panel curves partially around its side of the mast and then extends rearwardly from a line of tangency with its side of the mast, generally contiguous the mainsail panel. Each side panel of the mainsail is secured along its lower edge to a separate boom, so that the two booms can be swung apart to move the two sail panels into a "wing-out" position, for use when sailing with the wind.

22 Claims, 17 Drawing Figures

Fig. 3.
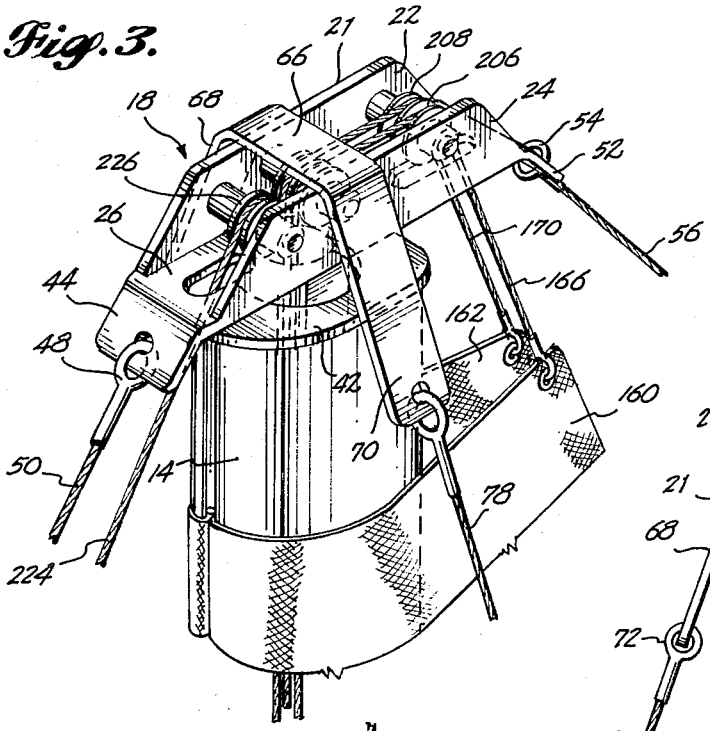
Fig. 4.
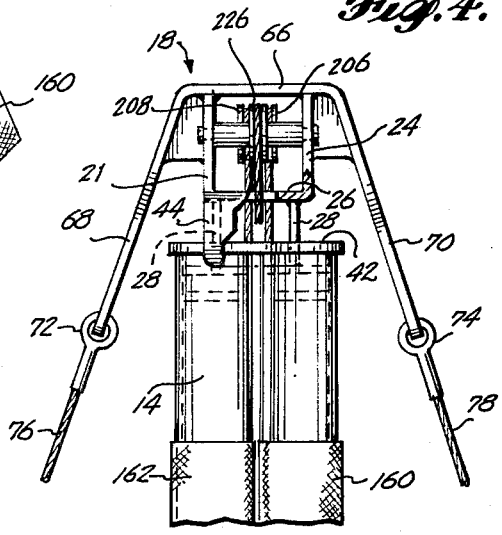
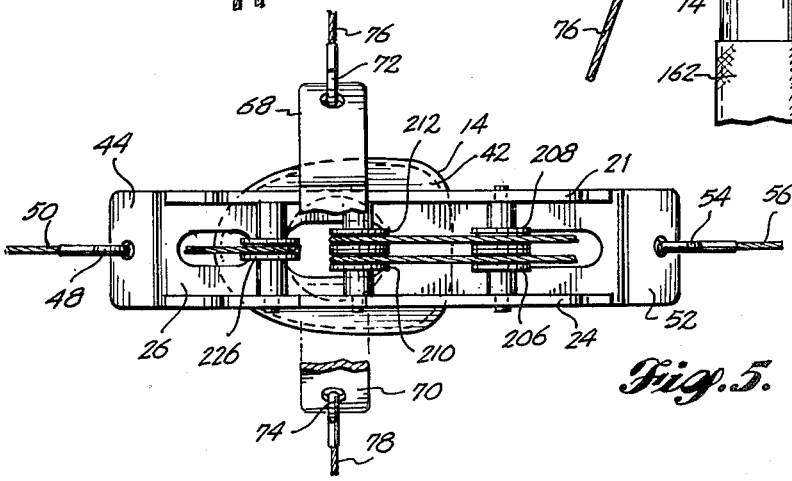
Fig. 5.
Fig. 6.
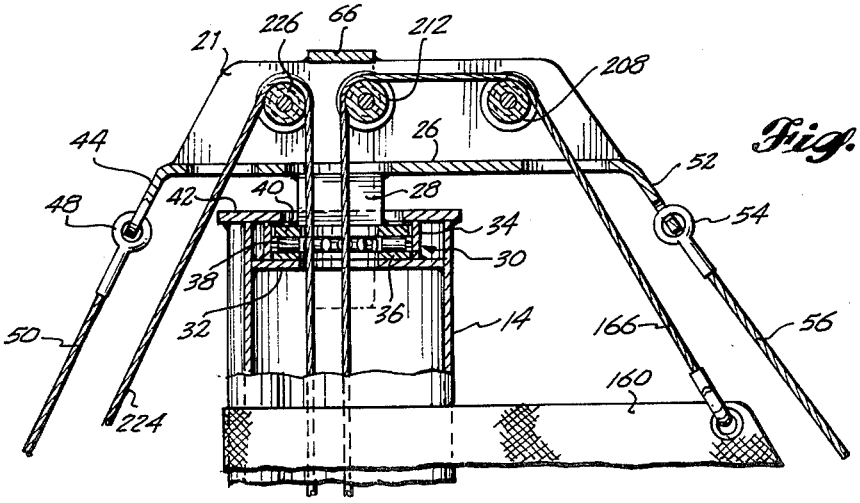

SAILING SYSTEM

RELATED APPLICATION

This is a continuation-in-part of application Ser. No. 705,590, filed July 15, 1976, and now abandoned, which also was entitled A Sailing System.

BACKGROUND OF THE INVENTION

1. Field of the Invention

This invention relates to an improved sailing system, and in particular to a construction and arrangement of a mainsail and its support rigging which results in a large increase in propulsive efficiency by reducing turbulence on the leeward side of the mainsail.

2. Description of the Prior Art

It has been well established, that, when a sailboat is either reaching or is beating to windward, (i.e. sailing generally into the wind) an important force acting on the boat is developed by the wind creating a partial vacuum or a pressure gradient on the leeward side of the sail. It has also been well established that a sail will be more efficient if the flow of air on the leeward side of the sail is relatively smooth and undisturbed as in laminar flow, than if the flow of air is turbulent. In a conventional sailing system, the mast causes considerable turbulence along the leeward side of the sail because it prevents a smooth entry of the wind to the leeward surface of the sail. Thus, the position of the mast with relation to the leading edge of the sail, relative to the wind direction, is extremely important in determining the character of flow on the leeward side of the sail, and therefore the efficiency of the sail.

As illustrated in FIG. 61 on page 96 of MARCHAJ, *Sailing Theory and Practice*, Dodd, Meade & Co., N.Y., 1964, and the accompanying text, an efficiency gain in the order of twenty-eight percent can be achieved if the mast is placed to windward of the leading edge of the sail on a round mast. This is illustrated on Model C of FIG. 61 of MARCHAJ. One way to achieve this, with a conventional mast, where the mainsail bolt rope is run up a groove in the after edge of the mast, would be to rotate the mast. For example, if the boat is on a port tack, the mast would be rotated counterclockwise (when looking down on the mast), thus wrapping the sail around the mast so that the forward edge of the sail leads from the leeward or starboard side of the mast. Conversely, if the boat is on a starboard tack, the mast would be rotated clockwise (when looking down on the mast), thus wrapping the sail around the mast so that the forward edge of the sail leads from the leeward or port side of the mast.

My sailing system comprises a rotating mast having at its top or masthead a masthead housing containing an antifriction bearing, a floating spreader having an antifriction bearing, and a mainsail having a slot permitting the sail to pass over the floating spreader when the sail is being wrapped around the mast.

Various embodiments of rotating masts have been used for many years. Presently, there are rotating masts on various multihull classes, both in the United States and in England as well as a number of racing dinghies. Some of these rotating masts are in use with conventional headsails. They do not, however, present the mast in a constant position of always being able to be on the windward side of the mainsail, and they do not have any spreaders that do not rotate with the mast. These rotating masts have rudimentary spreaders or struts that rotate with the mast and offer little support. A rotating mast gains little efficiency over conventional fixed masts because it does not solve the basic fault of the mast, viz. the sail produces turbulence on the leeward side of the mainsail or "bad air" on the leeward side of the mainsail. This "bad air", so to speak, is present because the shape of the mast disturbs the airflow on the back or leeward side of the sail. There have been through the years many attempts to change this "bad air" condition. For example, there is the Chinese lug sail, the modern rotating "wing" mast and attempts to support the mainsail independently of the mast. These innovations have had, only, partial success. The proof of this partial success is the lack of general acceptance by sailors.

My invention, by the use of "floating spreaders" that are not connected to the mast imparts the same efficiency to the main that was formerly possible only in headsails. Instead of "pushing" against the mast to prevent its deflection, the "floating spreader" is the part of the rigging that is put under strain and tension and "restrains" the mast as it attempts to bend out of shape. Of course, this line of action eliminates any and all through mast bolts or fastenings of any kind, making the mast much stronger for its shape and weight. The mast can, therefore, be made considerably smaller and lighter, thereby eliminating considerable weight and windage aloft, a desirable combination for increased speed under sail. This new development involves creating a sail which is reinforced where the slot in the sail clears the spreader. The mast, mounted on a turntable and held by the forestay and backstay attached to a housed bearing, can rotate 360° at each change of tack when tacking or beam reaching.

An additional advantage to be gained by the subject invention is the possibility of sheeting the genoas much closer to the centerline because the spreader arms are relatively short, 36″ wide on a 35′ deck mounted mast, and are positioned on the foreward side of the mast. Also, sail abrasion by the spreaders is virtually eliminated. Because the mast can be made smaller and more streamlined in section, and because there are no fastenings between the base and the masthead, there exists a greater safety factor in rough weather sailing. The laminar flow of air on the leeward side of the mainsail has a profound effect on the efficiency of the jib or jenny. The sails can be flattened more and the slot narrowed so as to bring the jib or jenny closer to the masts, because it is no longer necessary to compensate for poor performance of the mainsail.

The addition of a second mainsail member held in the bolt rope slot introduces the world's first "soft sail" "wing mast". It is no longer necessary to reverse the mast on changing tack because the mast is positioned slot forward and is completely encompassed by the two sails.

If desired, a split boom arrangement can be installed for the cruising sailor and both sail members "wing out" for sailing downwind. This doubling of the mainsail area from the cockpit eliminates the necessity for headsails, viz. spinnaker, ballooner, staysail, etc. A foredeck crew to handle these difficult-to-set sails is no longer necessary. This arrangement would be ideal for the cruising sailor or one who is shorthanded.

Also, elimination of the turbulence on the leeward side of the mainsail has a beneficial influence on the drive and efficiency of the jib. With a "floating"

spreader that has about 40% shorter arms than the conventional spreader and with the crossing foreshrouds, the jib can be sheeted in much closer in a tacking situation. Also, because of the absence of turbulence on the back of the mainsail, the wind in the slot areas is speeded up and there is less danger of backwinding the main, as would be the possibility with conventional rigging.

Because the mainsail is the most easily controlled sail aboard a sloop, the increased reliance with conventional systems, on the jib, genoa, staysail and spinnaker combination is very costly. The tall narrow rig (not, necessarily, devised for rotating purposes) involves a larger sail inventory, increased problems in staying the mast and additional demands on crew time and effort in setting, adjusting and maintaining the "headsail oriented attitude" on all points of sail. This has largely come about because these sails, supported on their respective forestays from the mainmast are free from the restrictions imposed by that mast, and are more efficient than the mainsail.

The acceptance of naval architects, designers and builders of the status quo in the mast, spreader and mainsail condition in its present form has resulted in more and more attention being paid to the development of headsail improvement. The modern sailing classes feature genoa sails with larger sail area than mainsails. The spinnaker has evolved where it is being used in all sailing courses except directly on the wind. This has resulted in the mast in the typical modern sloop rig being stayed further and further aft and resulting in the mainsail becoming smaller and less important in producing the power to drive the hull. The placement of the present-day mast and the reliance on the headsails detract from the importance of the mainsail and in moving the center of effort of the mainsail further aft profoundly affects the center of lateral resistance of the modern hull.

Once the loss in efficiency of the conventional mainsail is overcome and the mainsail becomes an efficient adjunct to the headsail drive, then there has been made a great improvement in the overall efficiency of the modern sailing boat of today. This is a main purpose of the subject invention.

Because the mainsail, in conjunction with the headsails, is, with my system, no longer at such disadvantage, and because the mainsail is so much more easily handled and controlled from the cockpit, it is possible that adoption of the subject system and its uses, especially among development racing classes, will profoundly affect hull design and sailing practice worldwide.

As the "floating spreader" eliminates the need for through fittings in the mast, the mast can be made smaller and lighter for racing and for curising rigs. Therefore, there is introduced a large safety factor.

Sailing systems and components thereof which can be found in the patent literature, and which should be considered when attempting to put my invention into proper perspective relative to the prior art, are shown by the following U.S. Pat: No. 92,577, granted July 13, 1869, to E. F. Burrows; No. 131,508, granted Sept. 24, 1872, to James H. David; No. 168,159, granted Sept. 28, 1875, to S. S. Jordan and J. C. Stevens; No. 383,594, granted May 29, 1888 to J. H. Rushton; No. 685,943, granted Nov. 5, 1901 to J. P. Pool; No. 3,149,603, granted Sept. 22, 1964 to Joseph DsainteClaire; No. 3,415,215, granted Dec. 10, 1968 to Oscar B. Plym; No. 3,487,800, granted Jan. 6, 1970 to Hoyle Schweitzer and James Drake; No. 3,610,190, granted Oct. 5, 1971 to Geoffrey C. Palmer; and No. 3,795,215, granted Mar. 5, 1974, to Frank W. Butler.

A sailing system as defined, herein, comprises the sails, mast, spreader, fittings, and all standing and running rigging on a sailboat, but not the sailboat itself. The description is concerned with the sailboat having a sloop-rig, that is, having a single mast, a triangular mainsail and a triangular jibsail or a genoa. However, it is to be recognized that my sailing system can be adapted for use with any marconi rig.

SUMMARY OF THE INVENTION

According to an aspect of the invention, the mast for the mainsail is mounted for rotation about its own axis, relative to the sailboat and to rigging provided for bracing and stabilizing the mast. The rigging may include a transverse spreader bar equipped with journal means which permits the mast to rotate relative to the spreader bar, but adapted to maintain the spreader bar substantially perpendicular to the mast.

According to another aspect of the invention, the mast includes a forwardly directed bolt rope receiving channel including a forwardly opening sail slot. The mainsail comprises two side parts or panels, each having a bolt rope secured along its forward edge. Each side panel of the mainsail extends from its bolt rope within the bolt rope channel, out through the sail slot, then partially around its side of the mast, and then rearwardly of the mast from a line of tangency with its side of the mast, generally contiguous the other side panel of the mainsail. When sailing generally into the wind, each side panel of the mainsail will curve smoothly from its line of tangency with the mast as it trails rearwardly from the mast, and turbulence on the leeward side of the mainsail is reduced.

According to another aspect of the invention, the lower edge of each mainsail panel is secured to its own boom. When sailing generally into the wind, the two booms are locked together to function together as one. However, when it is desired to sail with the wind, the two booms can be moved apart, so as to move the two mainsail panels apart so that they will extend generally away from each other on opposite sides of the mast.

It is well-known, that when a sailboat is beating to windward or is on a reach, a mast of circular cross-section will have more drag and will cause more turbulence than will a streamlined mast that can be positioned to the wind direction, see, generally, pages 91–93 of MARCHAJ, above. The sailing system of this invention may include a streamlined mast.

One of the objects and a resulting efficiency of this sailing system is having the sail on the leeward side of the mast thereby gaining an estimated approximate 28% increase in efficiency of the sailing system; a further important object and advantage is a one-piece spreader so as to lessen the possibility of the spreader breaking with the result that the mast goes over the side of the boat and a further advantage of the one-piece spreader is that it is safer than conventional multipiece spreaders, more dependable and reliable than multipiece spreaders, and largely eliminates breakage of the spreader and mast; another object and advantage is that there are no through fastenings in the mast from the boom of the mast to the masthead so as to have a stronger resulting mast; a further important object is to make it possible to sail closer to the wind and point higher because of the laminar flow of the air with the resulting decrease in turbulence on the leeward side of the sail; another object and advantage is to increase the efficiency of the sailing system as compared with conventional sailing systems; another desirable advantage is to be able to achieve a higher velocity of a sailboat and also for the sailboat to reach a higher hull speed more quickly than with a conventional sailing system; a further important object is that with this system, the mast is smaller in diameter than with the conventional sailing system as in this system there are no through fastenings in the mast to weaken the structure; another desirable advantage is that in this system, the mast is less expensive than with a conventional sailing system; another important object is that with this system, the sail is smaller than with a conventional sailing system and, therefore, the sail is less expensive, easier to store, easier to handle, and the resulting associated equipment is smaller and therefore, less expensive than with a conventional sailing system; another important object is that there is employed a lighter-weight mast with this system than with a conventional system as in this system there are no holes in the mast to weaken the mast, therefore, making it possible to employ a lighter weight mast; another important object and advantage is that this system is, basically, safer than a conventional sailing system as the boom can be locked in position so as not to swing and knock a crewman and possibly injure a crewman or knock the crewman overboard, and this system is safer as the mast is continuous and does not have holes and, therefore, is not weakened and the spreader does not project through the mast but is a one-piece spreader separate and apart from the mast thereby making it possible to have a stronger mast and a stronger spreader than with a conventional sailing system.

These and other important objects and advantages of the invention will be more particularly brought forth upon reference to the accompanying drawings, the detailed description of the invention, and the claims.

BRIEF DESCRIPTION OF THE DRAWING

FIG. 3 is an enlarged scale, fragmentary isometric view taken from above and looking towards the front and one side of the upper end portion of the mast, showing the masthead, the upper portion of the sail and upper portions of shroud lines;

FIG. 4 is a front elevational view of the components shown by FIG. 3;

FIG. 5 is a top plan view of the components of FIGS. 3 and 4, with parts cut away for clarity of illustration of other parts;

FIG. 6 is a port side elevational view of the components of FIGS. 3–5, with some parts cut away for clarity of illustration of other parts;

DESCRIPTION OF THE PREFERRED EMBODIMENT

Figure 1:
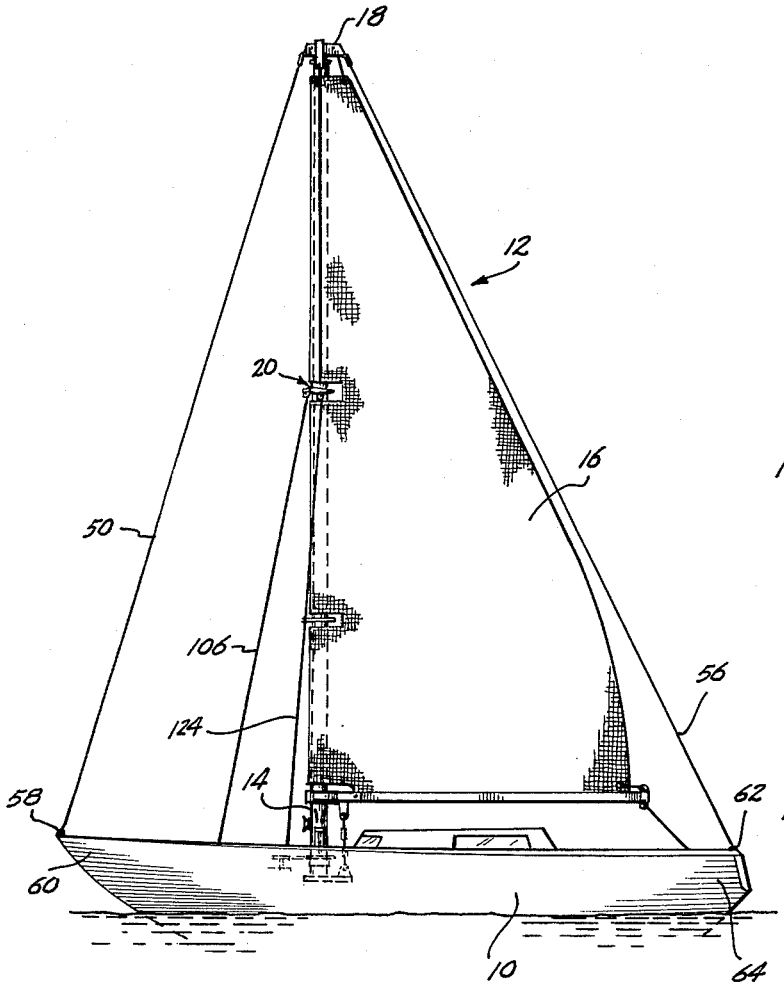
FIG. 1 is a port side elevational view of a sailing boat utilizing a sailing system constructed according to the present invention.
Figure 2:
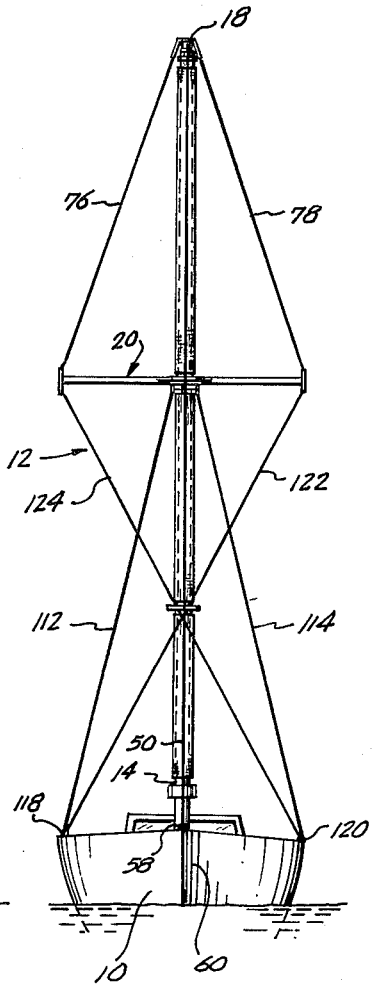
FIG. 2 is a front elevational view of the sailboat of FIG. 1.

The sailboat shown by FIGS. 1 and 2 comprises a hull 10 and a sailing system 12 constructed in accordance with the present invention.

The sailing system 12 comprises a mast 14, a mainsail 16, and rigging for the mast 14. The rigging comprises a masthead 18, a transverse spreader bar 20 and shrouds and stays which will hereinafter be described in some detail.

According to an aspect of the invention, the mast 14 is mounted for rotation about its own axis, relative to its rigging and to the boat hull 10. Preferably mast 14 is a tubular metal extrusion.

Referring now to FIGS. 3–6, the masthead 18 of the illustrated embodiment comprises an upwardly opening body 21 of channel form, having side walls 22, 24 interconnected at their lower edges by a bottom wall 26. A tubular stem 28 (FIG. 6) depends from bottom wall 26 and is received within a thrust bearing 30 which is housed within an upper portion of mast 14. As shown by FIG. 6, the upper end portion of the mast 14 is constructed to include an annular bearing support shelf 32 and a cylindrical retainer wall 34 connected along its lower edge to the shelf 32 and projecting upwardly therefrom to an upper edge which is flush with the upper edge of the mast side wall. The thrust bearing 30 comprises a lower raceway 36, a roller element assembly 38 comprising a cage and a plurality of roller elements, and an upper raceway 40. An annular cap 42 is secured to the upper end of mast 14 and is sized to overlap slightly the upper raceway 40. The masthead stem 28 includes a smaller diameter lower portion which is sized to fit downwardly through the open centers of the two raceways 40, 36, the roller assembly 38 and the support shelf 32. It also includes a larger diameter upper portion which rests on raceway 40. By way of typical and therefore nonlimitative example, the bearing assembly may be like the one disclosed in U.S. Pat. No. 4,042,285, granted Aug. 16, 1977 to Hans H. Dorsch.

The forward portion 44 of masthead bottom wall 26 is bent downwardly and is formed to include an opening for receiving an eye 48 at the upper end of a forestay 50. Similarly, the rear end portion 52 of wall 26 is bent downwardly and is formed to include an opening for receiving an eye 54 at the upper end of a backstay 56. As shown by FIG. 1, the forestay 50 extends downwardly from the masthead 18 to a point of connection 58 with the boat's bow 60. The backstay 56 extends downwardly from the masthead 18 to a point of connection 62 at the stern 64.

As best shown by FIGS. 3–4, the masthead 18 includes a cross arm having an intermediate portion 66 which is symmetrically attached to the upper edges of the side walls 22, 24, and a pair of wings or side portions 68, 70 which slope downwardly from the intermediate portion 66. Each wing 68, 70 is formed to include an opening for receiving an eye 72, 74 at the upper end of one of a pair of upper shroud lines 76, 78 which extend downwardly to points of connection 80, 82, respectively at the ends of the spreader bar 20 (FIG. 7).

Figure 7:
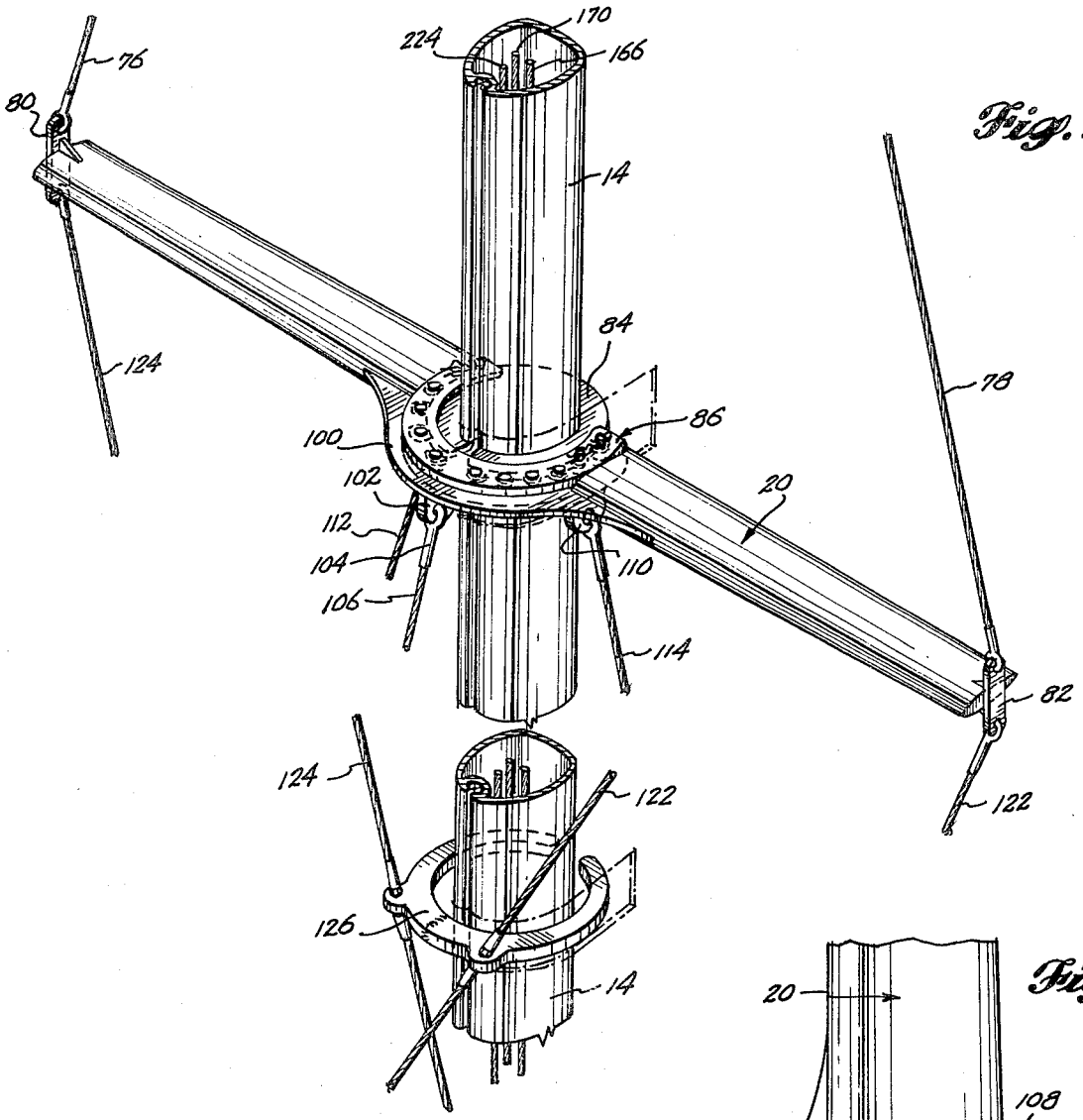
FIG. 7 is a fragmentary isometric view of a midportion of the mast and certain parts of its rigging, taken generally from the same aspect as FIG. 3.
Figure 9:
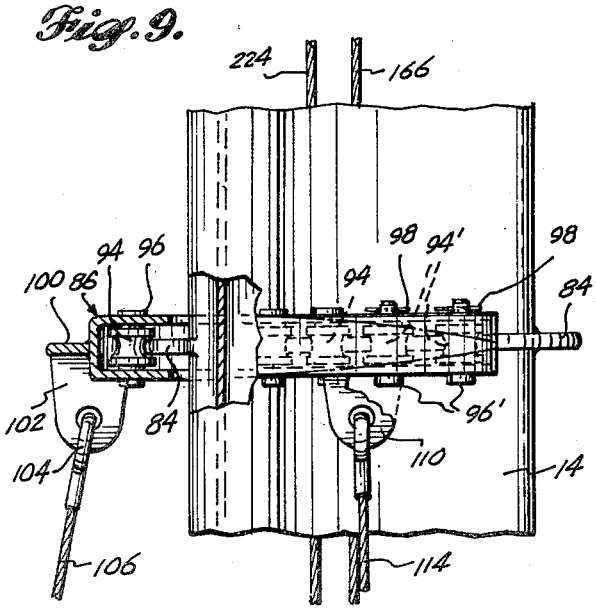
FIG. 9 is a fragmentary side elevational view of the mast in the region of the transverse spreader bar, with the spreader bar shown in section.
Figure 8:
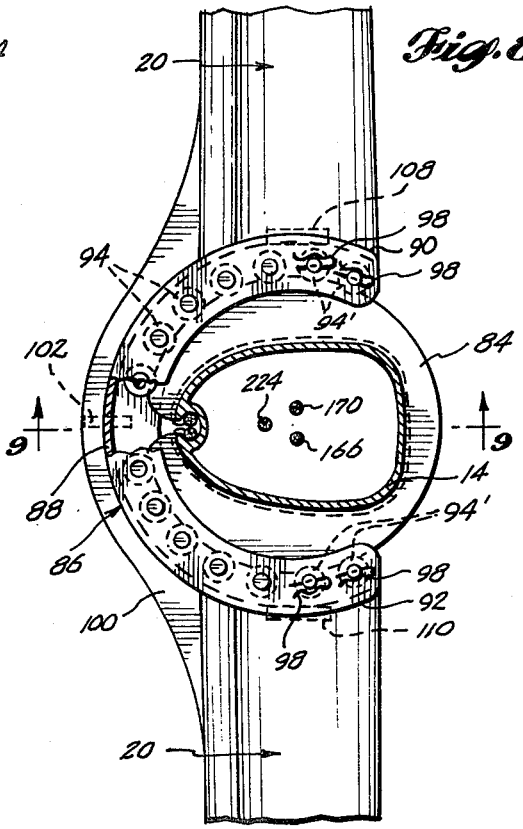
FIG. 8 is a transverse sectional view taken through the mast above the spreader bar, and showing a fragmentary portion of the spreader bar in top plan.

Referring now to FIGS. 7–9, a circular plate 84 is secured to the mast 18 in the region of the spreader bar 20. This plate 84, which may be termed a spreader plate, is larger in diameter than the cross-sectional dimension of the mast, and encircles the mast 14 (FIG. 8) like a collar. It is rigidly secured to the mast 14 so that it is capable of transmitting moments between the spreader bar 20 and the mast.

The central portion of the spreader bar 20 is in the form of a yoke 86. Yoke 86 includes a forward closed portion 88 and two arm portions 90, 92 which define a rearwardly opening entrance into the yoke. The front and side portions 88, 90, 92 are channel shaped in cross section, with the channel opening inwardly towards the mast 14. A plurality of circumferentially grooved rollers 94 are supported for rotation about axes which extend parallel to the axis of the mast 14. The rollers 94 may be supported for rotation by pins 96 which extend between the upper and lower walls of the yoke channel.

As best shown by FIGS. 8 and 9, the periphery of the spreader plate 84 is snugly received within the roller grooves. This arrangement permits rotation of the spreader plate 84 about its center axis, but the flanges on the rollers 94 prevent movement of the spreader bar 20 relative to the spreader plate 84 in essentially all other directions.

As best shown by FIG. 8, the group of rollers 94' that fall within the rear 180° sector of the yoke are mounted to be readily removable. By way of typical and therefore nonlimitative example, they may be mounted for rotation by pins 96' having lower end head portions and roller mounting shanks which project upwardly through aligned openings in the upper and lower walls of the yoke channel and in the rollers 94. The upper ends of such pins 96' may include transverse openings for receiving cotter pins 98. As shown by FIG. 8, when the spreader bar 20 is assembled onto the spreader plate 84, the outer two pairs (paired across the mouth of the yoke) of rollers 94' are spaced across the yoke from each other at distances which are smaller than the diameter of the spreader plate 84. As a result, they lock the spreader bar 20 onto the spreader plate 84. When it is desired to disassemble the spreader bar 20 from the mast 14, the cotter pins 98 are removed, allowing the mounting pins 96' to drop downwardly. Then, the rollers 94' are moved endwise out from the channel arms. After such rollers are removed, the spreader bar 20 can be moved laterally from the mast and away from the spreader plate 84. This is possible because upon removal of the rollers 94' the distance across the open end of the yoke is greater than the diameter of the spreader plate 84.

Preferably, a reinforcing gusset 100 is formed on the spreader bar 20, to extend around the forward wall of the yoke from a line of connection with the forward edge of one side portion of spreader bar 20 to a similar line of connection with the opposite side portion of the spreader bar 20. As shown by FIGS. 7 and 9, an apertured lug 102 may depend downwardly from the center of gusset 100 and serve as an anchor point for a connector 104 at the upper end of a front stay 106, two additional anchor lugs 108, 110 may depend downwardly from side portions of the yoke to serve as anchor points for the upper ends of a pair of side stays 112, 114.

As shown in FIG. 1, the front stay 106 extends downwardly from yoke lug 104 to a point of connection with the boat hull 10 situated between the mast 14 and the bow 58. As best shown by FIG. 2, the two side stays 112, 114 extend downwardly from their yoke lugs 108, 110 to points of connection 118, 120 with side portions of the hull 10.

The rigging also includes lower shrouds 122, 124 which extend from points of connection with the outer ends of the spreader bar 20 downwardly to points of connection with side portions of the boat hull 10. As shown by FIGS. 2 and 7, lower shroud 122 extends from connector 82 at one end of spreader bar 20 downwardly to points of connection with side portions of the boat hull 10. As shown by FIGS. 2 and 7, lower shroud 122 extends from connector 82 at one end of spreader bar 20 downwardly at a diagonal and connects to an opposite side location on the boat hull 10. The opposite lower shroud 124 extends from an upper point of connection with the connector 80 at the opposite end of spreader bar 20 downwardly along a diagonal to a point of connection with the opposite side of the boat hull 10. The two lower shrouds 122, 124 across each other at a location spaced slightly forwardly of the mast 14. Preferably, they are both connected to a floating ring 126 which is positioned a short distance above where they cross. The ring 126 loosely surrounds the mast 14, so that the mast can rotate relative to it.

Preferably, the opposite side portions of the spreader bar are airfoil shaped in cross section (FIG. 7).

Figures 10, 11:
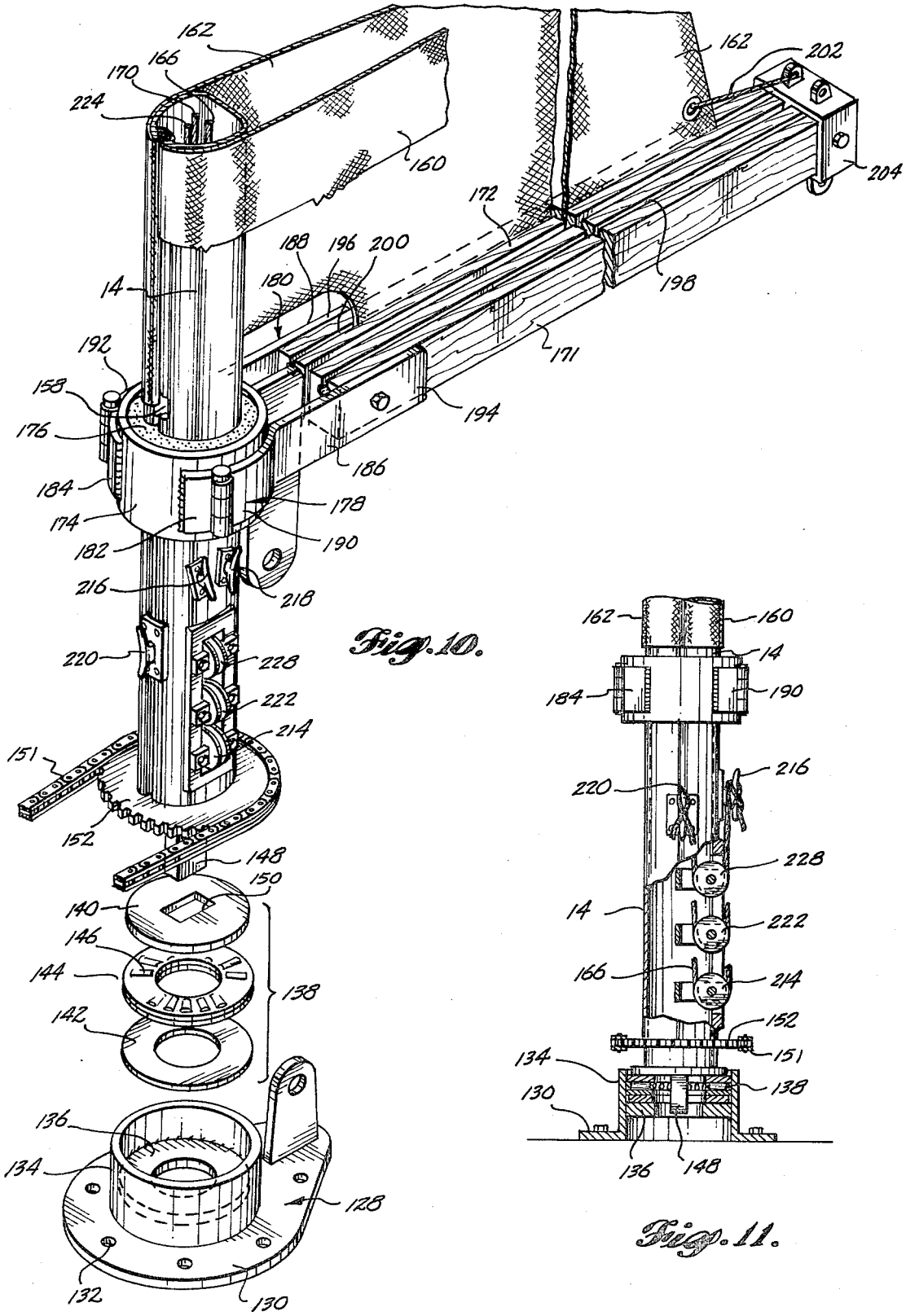
FIG. 10 is a fragmentary isometric view of the lower portion of the mast, with parts thereof exploded away, such view being taken substantially from the same aspect as FIGS. 3 and 7.
FIG. 11 is a fragmentary elevational view of the lower portion of the mast, with some parts shown in section and other parts cut away for clarity of illustration of still some other parts.

Referring now to FIGS. 10 and 11, the lower end of mast 14 is mounted for rotation on the boat hull 10 by means including a lower bearing housing 128. Bearing housing 128 may include a mounting plate 130 formed to include bolt receiving openings 132, and an upstanding cylindrical wall 134 forming a bearing cavity. A annular support shelf 136 is provided inside of the bearing cavity and is adapted to support a thrust bearing 138. Thrust bearing 138 comprises upper and lower raceways or thrust plates 140, 142, respectively, a roller cage 144, and a plurality of roller elements 146. Bearing 138 may also be generally like the bearing disclosed by U.S. Pat. No. 4,042,285. As best shown by FIG. 11, the bearing 138 is supported within the bearing cavity on the support shelf 136. A noncircular projection at the roller end of the mast 14, which is an integral part of the mast, extends downwardly through a similarly shaped opening 150 in the upper thrust plate 140, and then through oversized circular openings in the roller cage 144, the lower thrust plate 142 and the shelf 136. As will be appreciated, this arrangement prevents any lateral movement of the lower end of the mast 14, but allows rotation of the mast 14 about its own axis.

The mast 14 may be equipped with a drive sprocket 152, integrally attached to the mast at a location spaced upwardly a small distance above the lower end of the mast 14. A sprocket chain 151 engages sprocket 152 and is suitably driven for the purpose of supplying a rotational force to the mast 14.

The mounting flange 130 may be bolted directly to the deck portion of the boat hull 10.

As clearly shown by FIGS. 3, 7, 8, 10 and 12–17, the mast 14 is formed to include a normally forwardly directed bolt line channel 154. Channel 154 extends substantially the full length of the mast and includes an inner space which is large enough to easily accommodate two bolt ropes. A sail slot 156 communicating with the inner space is formed in the forward edge portion of the mast 14. Such slot 156 is narrower than the diameter of a single bolt rope, so that neither bolt rope can pass through it, but wide enough to easily accommodate two sails. In preferred form, the forward portion of the mast 14 is rounded and the rear wall is blunt.

As shown by FIG. 10, a bolt rope entrance or avenue 158 is provided at the lower end of the bolt rope channel 154. Such entrance is sized to easily accommodate two bolt ropes and it is through such entrance 158 that the bolt ropes are moved during assembly and disassembly of the mainsail onto the mast 14.

FIGS. 3, 10 and 13–17 show that the mainsail 16 is composed of two side parts or panels 160, 162, each of which is detached from the other. Each panel 160, 162 is generally triangular in shape (FIG. 1) and comprises a bolt rope incorporated into its forward edge and another bolt rope incorporated into its lower edge.

Figure 12:
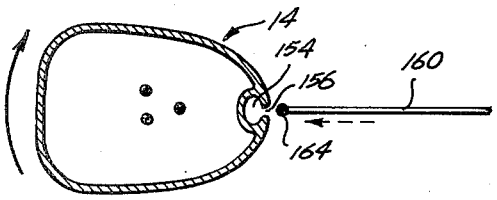
FIG. 12 is a cross-sectional view through the mast, showing one of the mainsail panels in a spaced relationship to the bolt rope channel in the mast.
Figure 13:
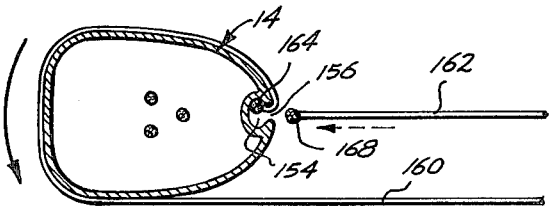
FIG. 13 is a view like FIG. 12, but showing the bolt rope of the first mainsail panel within the bolt rope channel, showing the mast rotated 360° from its position in FIG. 12, so that such first mainsail panel is wrapped around a substantial part of the mast, and showing the second mainsail panel in a spaced position relative to the bolt rope channel.
Figure 14:
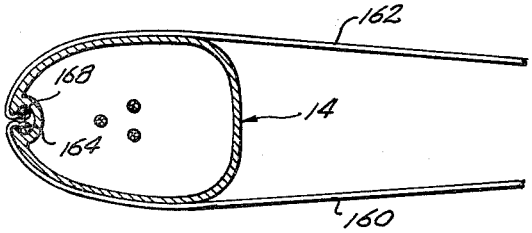
FIG. 14 is a view like FIGS. 12 and 13, but showing the bolt rope of the second mainsail panel also within the bolt rope channel, and showing the mast rotated back 180° from its position in FIG. 13, so that the two mainsail panels curve rearwardly along the forward side portions of the mast and each trails rearwardly from a line of tangency with its side of the mast.

Referring now to FIGS. 12–14, the mainsail 16 maybe attached to the mast 14 in the following manner: mast 14 is rotated to direct its bolt rope channel rearwardly. Then, the forward edge bolt rope of one of the sail panels, e.g. bolt line 164 of sail panel 160, is introduced, upper end first, into the entrance 158 of the bolt rope channel 154. Sail panel 160 is then moved relatively up the mast 14. This may be done by pulling upwardly on a haul line 166 connected to an upper rear corner portion of sail panel 160. When sail panel 160 is raised to the top of the mast, the mast is rotated 360° (see FIG. 13). This causes the sail panel 160 to be wrapped around a greater portion of the mast 14 and relocates the bolt rope channel 154 in a rearwardly facing direction. Then, the bolt rope 168 of the second mainsail panel 162 is introduced into the bolt rope channel 154 in the same manner as bolt line 164, and in performing this step a haul line 170 may be used for raising the mainsail panel 162 (FIG. 3). Once mainsail panel 162 has been installed, the mast 14 is rotated back 180° so as to place the bolt rope channel in a forward direction (FIG. 14). This also unwinds some of mainsail panel 160 from the mast 14 and winds a portion of mainsail panel 162 about the mast 14 (FIG. 14).

Two booms 171, 172 are connected to the mast 14 closely below the bolt rope entrance 158. As best shown by FIG. 10, a boom mounting collar 174 may be affixed to the mast 14. In the illustrated embodiment the member 174 is a cylindrical member of larger diameter than the mast 14. It encircles the mast and a suitable filler material 176 is located between it and the mast 14. The inner or mast end of each boom 171, 172 is hinge connected to the collar 174, such as by hinges 178, 180. Each of these hinges 178, 180 includes a first portion 182, 184 which is secured to the collar 174 and includes one-half of a knuckle hinge. The other half of the knuckle hinge is connected to a much longer second portion 186, 188 of the hinges 178, 180. Each second portion 186, 188 includes a mast end part 190, 192 which is curved to conform generally to the curvature of the ring 174, and a straight shank part 194, 196. The outer or free end of each shank part 194, 196 is bolted or otherwise secured to the mast end of its boom 171, 172.

Preferably, each boom 171, 172 is formed to include an upwardly opening bolt rope receiving channel 198, 200, each of which includes an inner space sized to accomodate a bolt rope and a sail slot sized to accommodate the thickness of a sail panel but being narrower than the diameter of a bolt rope.

After mainsail panel 160 is raised, the bolt rope at its lower edge is fed into the bolt rope channel 198 of boom 171. Similarly, after the second mainsail panel 162 is raised, the bolt rope at its lower edge is fed into the bolt rope channel 200 formed in boom 172. Or, in the alternative, the lower edge bolt ropes are installed into the boom channels 198, 200 before the mainsail panels 160, 162 are raised.

As should be apparent, when it is desired to lower the mainsail and remove it from the mast, the above described steps are reversed.

As best shown by FIG. 10, an elastic snubber line 202, or the like, is interconnected between the outer end of each boom 171, 172 and the lower rearward corner of its mainsail panel 160, 162, for maintaining the mainsail panels 160, 162 relatively taut in the horizontal direction generally lengthwise of the booms 171, 172.

An easily removable lock fitting or cup 204 is provided for holding the outer ends of the booms 171, 172 together, so that they will function essentially as a single boom. The booms 171, 172 are locked together when it is desired to use the mainsail 16 for sailing generally into the wind. When it is desired to sail generally with the wind, the lock fitting 204 may be unlocked or removed, and the two booms 171, 172 are moved apart until they extend away from each other on opposite sides of the mast. This causes the mainsail panels 160, 162 to be moved into a "wing out" position (FIG. 17), so that each panel 160, 162 will catch some of the wind. This use of the mainsail 16 eliminates the necessity for headsails, viz. a spinnaker, ballooners, stay sails, etc. A foredeck crew to handle these difficult-to-set sails is no longer necessary. This arrangement would be ideal for the cruising sailor or one who is shorthanded.

Figure 15:
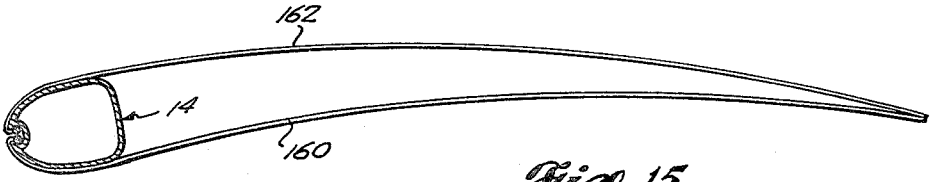
FIG. 15 is a smaller scale view similar to FIGS. 2–14, including the entire sail, and showing a typical orientation of the sail.
Figure 16:
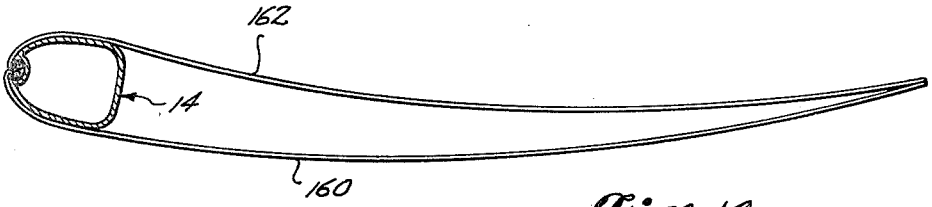
FIG. 16 is a view like FIG. 15, but with the starboard rather than the port side of the mainsail being leeward.
Figure 17:
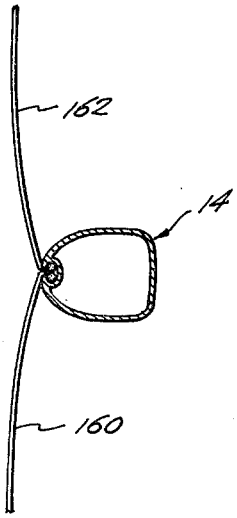
FIG. 17 is a view similar to FIGS. 12–16, but showing fragmented portions of the two mainsail panels winged out for sailing with the wind.

As best shown by FIGS. 14–16, when it is desired to sail generally into the wind, each mainsail panel 160, 162 extends from the forward edge sail slot around its side portion of the mast 14 and extends rearwardly from a line of tangency with its side of the mast, generally contiguous the other mainsail panel. Thus, there is a smooth curvature of each mainsail panel 160, 162 as it extends both around the rearwardly of the mast 14. As shown by FIGS. 15 and 16, the mainsail of this invention is essentially wing shaped in cross-section. However, it is still a "soft sail". FIGS. 15 and 16 show the mast 14 rotated somewhat in opposite directions, to help provide the desired cross-sectional shape.

Referring now to FIGS. 3–6, 10 and 11. The masthead 18 is provided with a pair of coaxial pulleys 206, 208 which are mounted for rotation between the two side walls 22, 24 near the rear end of the masthead body 21. A second coaxial pair of pulleys 210, 212 are mounted between the side walls 22, 24 in line with a central opening in bottom wall 26 leading into the hollow interior of tubular stem 28. Haul line 166 extends over pulley 206, then forwardly and over pulley 210, and then downwardly through first tubular stem 28 and then through the hollow center of the tubular mast 14. At the lower end of the mast haul line 166 extends under and then up and partially around a pulley 214 and then extends upwardly to one of three cleats 216, 218, 220 secured to side portions of the mast 14. In similar fashion, the haul line 170 extends from mainsail panel 162 up over pulley 208, then forwardly and over pulley 212, and then downwardly through the hollow interior of mast 14. The lower end of the haul line 170 extends under and then up and partially around another pulley 222 and then upwardly to be tied onto one of the cleats 216, 218, 220.

A jib sail is not shown in FIG. 1. However, a jib sail will be sometimes used. In FIGS. 3–6, a haul line 224 for a jib sail (not shown) extends upwardly over a single pulley 226 which is mounted for rotation between forward portions of the masthead side walls 22, 24, and from pulley 226 extends downwardly through the hollow interior of mast 14.

At the lower end of the mast the jib haul line extends under and then up and partially around still another pulley 228 and then is tied to the third stay 216, 218, 220. As best shown by FIGS. 10 and 11, the three pulleys, 214, 222, 228 may be mounted within an elongated slot-like opening in the lower portion of mast 14, either separately or as part of a single assembly.

What is claimed is:

1. A sailing system comprising:

an elongated mast;

a mainsail connected to the elongated mast; and means for mounting the mast onto a boat for 360° rotation about its own axis, and for bracing the mast against buckling, said means comprising a masthead at the upper end of said mast, including first journal means engaging the upper end of the mast and allowing the mast to rotate about its own axis relative to the masthead; second journal means mountable onto a boat hull, for engaging the lower end of the mast and allowing the mast to rotate about its own axis relative to the boat hull; a transverse spreader bar extending crosswise of an intermediate portion of said mast; third journal means between said mast and said spreader bar allowing said mast to rotate about its own axis relative to said spreader bar, but maintaining the spreader bar substantially perpendicular to the mast; and shroud means connectible between the masthead and the spreader bar and a boat hull.

2. A sailing system according to claim 1, wherein said third journal means comprises a circular mast plate integrally connected to the mast and including a radially projecting rim portion substantially encircling the mast; and a plurality of circumferentially grooved rollers mounted onto a central portion of the transverse spreader bar for rotation about axes which are generally parallel to the axis of the mast, with the rim portion of the mast plate within the circumferential grooves.

3. A sailing system according to claim 2, wherein the transverse spreader bar includes a generally U-shaped yoke at its center onto which the circumferentially grooved rollers are mounted on a circle throughout an angular region which exceeds 180°, so that at least one pair of circumferentially grooved rollers which are spaced apart from each other across the mouth of the yoke will maintain the spreader bar on the circular mast plate.

4. A sailing system according to claim 3, comprising removable pins for mounting the circumferentially grooved rollers which lie beyond the inner 180° region of the yoke and function to maintain the spreader bar on the circular mast plate, so that such rollers can be removed to permit installation and removal of the spreader bar onto the circular mast plate.

5. A sailing system comprising:

a soft fabric mainsail comprising two individual soft fabric side panels, each extending the full extent of the mainsail, each of said soft fabric side panels having a leading edge and a bolt rope incorporated into its leading edge;

a unitary elongated mast having a forwardly rounded mainsail mounting portion, a bolt rope channel extending the full length of said mainsail mounting portion and including an inner space, a forwardly opening sail slot leading into said inner space, and a bolt rope avenue leading into said inner space and located at the lower end of said sail slot at an elevation above the bottom of the mast, said inner space being sized to accommodate the two bolt ropes for the two soft fabric side panels of the soft fabric mainsail, said sail slot being wider than the combined fabric thickness of the two soft fabric side panels of the soft fabric mainsail but narrower than a single one of the bolt ropes, and said bolt rope avenue being sized to allow passage of a said bolt rope therethrough;

wherein said bolt ropes are both located within the inner space of said channel, and wherein during use of the sailing system for sailing generally into the wind one soft fabric side panel of the mainsail extends from its bolt rope out through the sail slot, then partially around a first side of the mast, and then rearwardly of the mast from a line of tangency with its side of the mast, and the other soft fabric side panel of the soft fabric mainsail extends from its bolt rope out through the sail slot, then partially around the opposite side of the mast, and then rearwardly of the mast from a line of tangency with its side of the mast, generally continuous with but detached from the first soft fabric side panel of the soft fabric mainsail, so that when sailing generally into the wind each soft fabric side panel of the soft fabric mainsail will curve smoothly from its line of tangency with the mast as it trails rearwardly from the mast and turbulence on the leeward side of the soft fabric mainsail is reduced;

means for mounting the mast onto a boat for 360° rotation about its own axis, so that the two soft fabric side panels of the soft fabric mainsail can be separately installed onto and removed from the mast; and separate hull line means for each fabric side panel, for separately raising and lowering said fabric side panels, each relative to the other, up and down said mast.

6. A sailing system comprising:

a soft fabric mainsail comprising two soft fabric side panels, each extending the full extent of the mainsail, each of said soft fabric side panels having a leading edge and a bolt rope incorporated into its leading edge;

an elongated mast having a forwardly rounded mainsail mounting portion, a bolt rope channel extending the full length of said mainsail mounting portion and including an inner space, a forwardly opening sail slot leading into said inner space, and a bolt rope avenue leading into said inner space located at the lower end of said sail slot, said inner space being sized to accommodate the two bolt ropes for the two soft fabric side panels of the soft fabric mainsail, said sail slot being wider than the combined fabric thicknesses of the two soft fabric side panels of the soft fabric mainsail but narrower than a single one of the bolt ropes, and said bolt rope avenue being sized to allow passage of said bolt rope therethrough;

wherein said bolt ropes are both located within the inner space of said channel, and wherein during use of the sailing system for sailing generally into the wind one soft fabric side panel of the mainsail extends from its bolt rope out through the sail slot, then partially around a first side of the mast, and then rearwardly of the mast from a line of tangency with its side of the mast, and the other soft fabric side panel of the soft fabric mainsail extends from its bolt rope out through the sail slot, then partially around the opposite side of the mast, and then rearwardly of the mast from a line of tangency with its side of the mast, generally contiguous with the first soft fabric side panel of the soft fabric mainsail, so that when sailing generally into the wind each soft fabric side panel of the soft fabric mainsail will curve smoothly from its line of tangency with the mast as it trails rearwardly from the mast and turbulence on the leeward side of the soft fabric mainsail is reduced;

means for mounting the mast onto a boat for 360° rotation about its own axis, so that the two soft fabric side panels of the soft fabric mainsail can be separately installed onto and removed from the mast;

a pair of booms extending generally perpendicularly of the mast, generally below the entrance into the bolt rope channel, each of said booms including means at its mast end mounting it onto the mast for sideways pivotal movement about the longitudinal axis of the mast, and each soft fabric side panel of the soft fabric mainsail including a lower edge portion which extends along and is secured to a related one of said booms, and lock means for holding such booms together so that when sailing generally into the wind the lower edges of the two soft fabric side panels of the soft fabric mainsail can be maintained generally together, said lock means being operable to release said two booms so that they can be swung apart to move the soft fabric side panels of the soft fabric mainsail apart, to extend generally away from each other on opposite sides of the mast, when sailing generally with the wind; and separate haul line means for each fabric side panel, for separately raising and lowering said fabric side panels up and down said mast.

7. A sailing system comprising:

a soft fabric mainsail comprising two soft fabric side panels, each said soft fabric side panel having a leading edge and a bolt rope incorporated into its leading edge;

an elongated mast having a forwardly rounded mainsail mounting portion, a bolt rope channel extending the full length of said mainsail mounting portion and including an inner space, a forwardly opening sail slot leading into said inner space, and a bolt rope avenue leading into said inner space located at the lower end of said sail slot, said inner space being sized to accommodate the two bolt ropes for the two soft fabric side panels of the soft fabric mainsail, said sail slot being wider than the combined fabric thicknesses of the two soft fabric side panels of the soft fabric mainsail but narrower than a single one of the bolt ropes, and said bolt rope avenue being sized to allow passage of a said bolt rope therethough;

wherein said bolt ropes are both located within the inner space of said channel, and wherein during use of the sailing system for sailing generally into the wind one soft fabric side panel of the mainsail extends from its bolt rope out through the sail slot, then partially around a first side of the mast, and then rearwardly of the mast from a line of tangency with its side of the mast, and the other soft fabric side panel of the soft fabric mainsail extends from its bolt rope out through the sail slot, then partially around the opposite side of the mast, and then rearwardly of the mast from a line of tangency with its side of the mast, generally continguous with the first soft fabric side panel of the soft fabric mainsail, so that when sailing generally into the wind each soft fabric side panel of the soft fabric mainsail will curve smoothly from its line of tangency with the mast as it trails rearwardly from the mast and turbulence on the leeward side of the soft fabric mainsail is reduced;

means for mounting the mast onto a boat for 360° rotation aout its own axis, so that the two soft fabric side panels of the soft fabric mainsail can be installed onto and removed from the mast;

means for bracing the mast against buckling, said means comprising a masthead at the upper end of said mast, including first journal means engaging the upper end of the mast and allowing the mast to rotate about its own axis relative to the masthead;

a transverse spreader bar extending crosswise of an intermediate portion of said mast;

second journal means between said mast and said spreader bar allowing said mast to rotate about its own axis relative to said spreader bar, but maintaining the spreader bar substantially perpendicular to the mast; and shroud means connectible between the masthead and the spreader bar and a boat hull.

8. A sailing system according to claim 7, wherein said shroud means includes a first upper shroud interconnected between the masthead and one end of the transverse spreader bar, a second upper shroud interconnected between the masthead and the opposite end of the transverse spreader bar, a first lower shroud connected at one of its ends to one end of the transverse spreader bar and including means for connecting its opposite end to an opposite side portion of the boat hull, so that such first lower shroud will extend from its end of the transverse spreader bar diagonally across the mast to its location of connection with the boat hull; and a second lower shroud connected at one of its ends to the opposite end of the transverse spreader bar and including means for connecting its opposite end to an opposite side portion of the boat hull, so that such second lower shroud will extend from its end of the transverse spreader bar diagonally across the mast to its location of connection with the boat hull.

9. A sailing system according to claim 7, wherein said shroud means comprises a plurality of stays which are connected at their upper ends to the transverse spreader bar, closely adjacent the mast, said stays including connectors at their opposite ends for connecting them to the boat hull at locations spaced laterally outwardly from the mast.

10. A sailing system according to claim 7, wherein said second journal means comprises a circular mast plate integrally connected to the mast and including a radially projecting rim portion substantially encircling the mast, said rim including a sail slot aligned with the sail slot leading into said bolt rope channel; and a plurality of circumferentially grooved rollers mounted onto a central portion of the transverse spreader bar for rotation about axes which are generally parallel to the axis of the mast, with the rim portion of the mast plate within the circumferential grooves.

11. A sailing system according to claim 10, wherein the transverse spreader bar includes a generally U-shaped yoke at its center onto which the circumferentially grooved rollers are mounted on a circle throughout an angular region which exceeds 180°, so that at least one pair of circumferentially grooved rollers which are spaced apart from each other across the mouth of the yoke will maintain the spreader bar on the circular mast plate.

12. A sailing system according to claim 11, comprising removable pins for mounting the circumferentially grooved rollers which lie outwardly beyond the inner 180° region of the yoke and function to maintain the spreader bar on the circular mast plate, so that such rollers can be removed to permit installation and removal of the spreader bar onto the circular mast plate.

13. A sailboat comprising:

a hull;

a soft fabric mainsail comprising two separate soft fabric side panels, each extending the full extent of the mainsail, each of said soft fabric side panels having a leading edge, a bolt rope incorporated into its leading edge, and a trailing edge, with the trailing edges of said side panels together forming the trailing portion of the mainsail;

a unitary, elongated mast having a lower end and a forwardly rounded mainsail mounting portion, a bolt rope channel extending the full length of said mainsail mounting portion and including an inner space, a forwardly opening sail slot leading into said inner space, and a bolt rope avenue leading into the said inner space and located at the lower end of said sail slot at an elevation above the bottom of the mast, said inner space being sized to accommodate the two bolt ropes for the two soft fabric side panels of the soft fabric mainsail, said sail slot being wider than the combined fabric thicknesses of the two soft fabric side panels of the soft fabric mainsail but narrower than a single one of the bolt ropes, and said bolt rope avenue being sized to allow passage of a said bolt rope therethrough;

wherein said bolt ropes are both located within the inner space of said channel, and wherein during use of the sailing system for sailing generally into the wind one soft fabric side panel of the mainsail extends from its bolt rope out through the sail slot, then partially around a first side of the mast, and then rearwardly of the mast from a line of tangency with its side of the mast, and the other soft fabric side panel of the soft fabric mainsail extends from its bolt rope out through the sail slot, then partially around the opposite side of the mast, and then rearwardly of the mast from a line of tangency with its side of the mast, generally continguous with the first soft fabric side panel of the soft fabric mainsail, so that when sailing generally into the wind each soft fabric side panel of the soft fabric mainsail will curve smoothly from its line of tangency with the mast as it trails rearwardly from the mast and turbulence on the leeward side of the soft fabric mainsail is reduced;

means abutting the bottom end of the mast for mounting the lower end of the mast onto the boat hull;

separate haul line means for for each fabric side panel, for separately raising and lowering said fabric side panels up and down said mast; and with the inner space of said bolt rope channel being large enough to house the bolt rope of a raised one of said fabric side panels while at the same time permitting movement therein of the bolt rope for the other fabric side panel during raising or lowering of same.

14. A sailboat according to claim 13, wherein the means mounting the lower end of the mast onto the boat hull mounts the mast for 360° rotation about its own axis, so that the two soft fabric side portions of the soft fabric mainsail can be installed onto and removed from the mast.

15. A sailboat comprising:

a hull a soft fabric mainsail comprising two soft fabric side panels, each extending the full extent of the mainsail, each of said soft fabric side panels having a leading edge and a bolt rope incorporated into its leading edge;

an elongated mast having a lower end and a forwardly rounded mainsail mounting portion, a bolt rope channel extending the full length of said mainsail mounting portion and including an inner space, a forwardly opening sail slot leading into said inner space, and a bolt rope avenue leading into said inner space located at the lower end of said sail slot, said inner space being sized to accommodate the two bolt ropes for the two soft fabric side panels of the soft fabric mainsail, said sail slot being wider than the combined fabric thicknesses of the two soft fabric side panels of the soft fabric mainsail but narrower than a single one of the bolt ropes, and said bolt rope avenue being sized to allow passage of said bolt rope therethrough;

wherein said bolt ropes are both located within the inner space of said channel, and wherein during use of the sailing system for sailing generally into the wind one soft fabric side panel of the mainsail extends from its bolt rope out through the sail slot, then partially around a first side of the mast, and then rearwardly of the mast from a line of tangency with its side of the mast, and the other soft fabric side panel of the soft fabric mainsail extends from its bolt rope out through the sail slot, then partially around the opposite side of the mast, and then rearwardly of the mast from a line of tangency with its side of the mast, generally continguous with the first soft fabric side panel of the soft fabric mainsail, so that when sailing generally into the wind each soft fabric side panel of the soft fabric mainsail will curve smoothly from its line of tangency with the mast as it trails rearwardly from the mast and turbulence on the leeward side of the soft fabric mainsail is reduced;

means for mounting the lower end of the mast onto the boat hull;

wherein the means mounting the lower end of the mast onto the boat hull mounts the mast for 360° rotation about its own axis, so that the two soft fabric side portions of the soft fabric mainsail can be installed onto and removed from the mast;

a pair of booms extending generally perpendicularly of the mast, generally below the entrance into the bolt rope channel, each of said booms including means at its mast end mounting it onto the mast for sideways pivotal movement about the longitudinal axis of the mast, and each soft fabric side panel of the soft fabric mainsail including a lower edge portion which extends along and is secured to a related one of said booms; and lock means for holding such booms together so that in sailing generally into the wind the lower edges of the two soft fabric side panels of the soft fabric mainsail can be maintained generally together, said lock means being operable to release said two booms so that they can be swung apart to move the soft fabric side panels of the soft fabric mainsail apart, to extend generally away from each other on opposite sides of the mast, when sailing generally with the wind; and separate haul line means for each fabric side panel, for separately raising and lowering said fabric side panels, each relative to the other, up and down said mast.

16. A sailboat comprising:

a hull;

a soft fabric mainsail comprising two soft fabric side panels, each said soft fabric side panel having a leading edge and a bolt rope incorporated into its leading edge;

an elongated mast having a lower end and a forwardly rounded mainsail mounting portion, a bolt rope channel extending the full length of said mainsail mounting portion and including an inner space, a forwardly opening sail slot leading into said inner space, and bolt rope avenue leading into said inner space located at the lower end of said sail slot, said inner space being sized to accommodate the two bolt ropes for the two soft fabric side panels of the soft fabric mainsail, said sail slot being wider than the combined fabric thicknesses of the two soft fabric side panels of the soft fabric mainsail but narrower than a single one of the bolt ropes, and said bolt rope avenue being sized to allow passage of a said bolt rope therethrough;

wherein said bolt ropes are both located within the inner space of said channel, and wherein during use of the sailing system for sailing generally into the wind one soft fabric side panel of the mainsail extends from its bolt rope out through the sail slot, then partially around a first side of the mast, and then rearwardly of the mast from a line of tangency with its side of the mast, and the other soft fabric side panel of the soft fabric mainsail extends from its bolt rope out through the sail slot, then partially around the opposite side of the mast, and then rearwardly of the mast from a line of tangency with its side of the mast, generally continguous with the first soft fabric side panel of the soft fabric mainsail, so that when sailing generally into the wind each soft fabric side panel of the soft fabric mainsail will curve smoothly from its line of tangency with the mast as it trails rearwardly from the mast and turbulence on the leeward side of the soft fabric mainsail is reduced;

means for mounting the lower end of the mast onto the boat hull;

wherein the means mounting the lower end of the mast onto the boat hull mounts the mast for 360° rotation about its own axis, so that the two soft fabric side portions of the soft fabric mainsail can be installed onto and removed from the mast; and means for bracing the mast against buckling, said means comprising a masthead at the upper end of said mast, including first journal means engaging the upper end of the mast and allowing the mast to rotate about its own axis relative to the masthead;

a transverse spreader bar extending crosswise of an intermediate portion of said mast;

second journal means allowing said mast to rotate about its own axis relative to said spreader bar; but maintaining the spreader bar substantially perpendicular to the mast; and shroud means connected between the masthead and the spreader bar and a boat hull.

17. A sailing system according to claim 16, wherein said shroud means includes a first upper shroud interconnected between the masthead and one end of the transverse spreader bar, a second upper shroud interconnected between the masthead and the opposite end of the transverse spreader bar, a first lower shroud connected at one of its ends to one end of the transverse spreader bar and connected at its opposite end to an opposite side portion of the boat hull, so that such first lower shroud will extend from its end of the transverse spreader bar diagonally across the mast to its location of connection with the boat hull; and a second lower shroud connected at one of its ends to the opposite end of the transverse spreader bar and being connected at its second end to an opposite side portion of the boat hull, so that such second lower shroud extends from its point of connection with the transverse spreader bar diagonally across the mast to its location of connection with the boat hull.

18. A sailboat according to claim 16, wherein said shroud means comprises a plurality of stays which are connected at their upper ends to the transverse spreader bar, closely adjacent the mast, said stays including connectors at their opposite ends connecting them to the boat hull at locations spaced laterally outwardly from the mast.

19. A sailboat according to claim 16, wherein said second journal means comprises a circular mast plate integrally connected to the mast and including a radially projecting rim portion substantially encircling the mast, said rim including a sail slot aligned with the sail slot leading into said bolt rope channel; and a plurality of circumferentially grooved rollers mounted onto a central portion of the transverse spreader bar for rotation about axes which are generally parallel to the axis of the mast, with the rim portion of the mast plate within the circumferential grooves.

20. A sailboat according to claim 19, wherein the transverse spreader bar includes a generally U-shaped yoke at its center onto which the circumferentially grooved rollers are mounted on a circle throughout an angular region which exceeds 180°, so that at least one pair of circumferentially grooved rollers which are spaced apart from each other across the mouth of the yoke will maintain the spreader bar on the circular mast plate.

21. A sailboat according to claim 20, comprising removable pins for mounting the circumferentially grooved rollers which lie outwardly beyond the inner 180° region of the yoke, and which function to maintain the spreader bar on the circular mast plate, so that such rollers can be removed to permit installation and removal of the spreader bar onto the circular mast plate.

22. A method for attaching a sail to a mast of a sail boat, said sail having two soft fabric side panels with each of said side panels having a leading edge and a bolt rope incorporated into its leading edge; and said must having a forwardly rounded sail mounting portion, a bolt rope channel extending the full length of said sail mounting portion and including an inner space, a forwardly open sail slot leading into said inner space, and a bolt rope avenue leading into said inner space and located at the lower end of said sail slot at an elevation above the bottom of said mast, said inner space being sized to accommodate the two bolt ropes for the two soft fabric side panels, said sail slot being wider than the combined fabric thicknesses of the two soft fabric side panels but narrower than a single one of the bolt ropes, and said bolt rope avenue being sized to allow passage of the bolt rope therethrough, said method comprising:

(a) rotating the mast so that the bolt rope channel is directed rearwardly, (b) engaging the bolt rope of a first said panel upwardly through the bolt rope avenue and then upwardly into the mast inner space to raise the first sail panel to the top of the mast, (c) rotating the mast 360° thereby wrapping the first sail panel around the mast and again locating the bolt rope channel in a rearwardly facing direction, (d) engaging the bolt rope of the second sail panel upwardly through the bolt rope avenue and then upwardly into the mast inner space to raise the second sail panel to the top of the mast, and (e) rotating the mast 180° in reverse direction to locate the bolt rope channel in a forwardly direction with each sail panel extending partially around its corresponding side of the mast and then rearwardly of the mast from the line of tangency with its side of the mast in generally contiguous, but separate relationship.

* * * * *